US008317057B2

(12) United States Patent
West

(10) Patent No.: US 8,317,057 B2
(45) Date of Patent: Nov. 27, 2012

(54) PAINT ROLLER PAINT SAVING PAN

(76) Inventor: Terry Dennis West, DeKalb, IL (US)

( * ) Notice: Subject to any disclaimer, the term of this patent is extended or adjusted under 35 U.S.C. 154(b) by 0 days.

(21) Appl. No.: 13/222,314

(22) Filed: Aug. 31, 2011

(65) Prior Publication Data

US 2012/0228316 A1 Sep. 13, 2012

Related U.S. Application Data

(60) Provisional application No. 61/464,597, filed on Mar. 7, 2011.

(51) Int. Cl.
*B65D 25/20* (2006.01)
*B65D 90/00* (2006.01)

(52) U.S. Cl. ..... 220/571.1; 220/501; 220/572; 220/700; 220/735

(58) Field of Classification Search ..... 220/501, 220/570, 571.1, 572, 695, 697, 698, 699, 220/700, 701, 735
See application file for complete search history.

(56) References Cited

U.S. PATENT DOCUMENTS

| | | | | | |
|---|---|---|---|---|---|
| 2,704,931 | A * | 3/1955 | Zelkowitz | 68/213 |
| 2,873,881 | A * | 2/1959 | Nichols | 220/697 |
| 3,395,828 | A * | 8/1968 | Schnabel | 220/697 |
| 4,708,152 | A | 11/1987 | Hibberd | |
| 5,363,869 | A | 11/1994 | McDowell | |
| 5,402,808 | A | 4/1995 | Wallis et al. | |
| 5,641,007 | A * | 6/1997 | Falk | 141/106 |
| 5,829,603 | A * | 11/1998 | Martineau | 211/66 |
| 5,878,881 | A * | 3/1999 | Hunt | 206/361 |
| 6,408,862 | B1 | 6/2002 | van Rooyen | |
| 6,695,164 | B1 * | 2/2004 | Chayer | 220/735 |
| 7,870,636 | B2 * | 1/2011 | LeCompte et al. | 15/261 |
| 2005/0138750 | A1 | 6/2005 | Trincilla et al. | |
| 2006/0016464 | A1 * | 1/2006 | Dominey | 134/201 |
| 2007/0183255 | A1 | 8/2007 | Whitney | |
| 2008/0105284 | A1 | 5/2008 | Bates | |
| 2011/0017242 | A1 | 1/2011 | Fiorino et al. | |
| 2011/0041880 | A1 | 2/2011 | Sheffield | |

OTHER PUBLICATIONS

Paint Brush and Paint Roller Cleaning Tool; http://www.buyacehardware.com/paint-brush-and-paint-roller-cleaning-tool-11147.html; 1 page printed from the Internet; date last visited Aug. 30, 2011.

(Continued)

*Primary Examiner* — Mickey Yu
*Assistant Examiner* — Niki Eloshway
(74) *Attorney, Agent, or Firm* — Reinhart Boerner Van Deuren P.C.

(57) ABSTRACT

A paint roller paint saving pan for a tubular roller pad is provided. The paint roller paint saving pan includes a paint can attachment portion configured to removably axially support the paint roller paint saving pan relative to an open end of an open paint can. A roller pad support portion is configured to radially support an end of the roller pad. A paint catching portion is positioned adjacent and vertically below the roller pad support portion and includes a through passage permitting fluid communication into the paint can when the paint can attachment portion is vertically supported on the paint can such that paint scraped from the roller pad supported by the roller pad support portion can return back to the paint can. The paint roller paint saving pan is configured to provide access to the roller pad by a rigid tool to scrape excess paint therefrom.

18 Claims, 6 Drawing Sheets

OTHER PUBLICATIONS

Pro-Design Bucket, 6 Gallon; http://www.google.com/products/catalog?q=paint+bucket+roller+cleaner&hl=en&prmd=ivns&bav=on.2,or.r_gc.r_pw.&biw=1440&bih=785&um=1&ie=UTF-8&tbm=shop&cid=2830499610068040537&sa=X&ei= kiPyTfenDajm0QGPvLTOCw&ved=0CFwQ8wlwAw; 1 page printed from the Internet; date last visited Aug. 30, 2011.

Brush & Roller Cleaner by Mintcraft; http://www.amazon.com/Mintcraft-15500-Brush-Roller-Cleaner/dp/B0026KW20I; 4 pages printed from the Internet; date last visited Aug. 30, 2011.

* cited by examiner

PAINT ROLLER PAINT SAVING PAN

CROSS-REFERENCE TO RELATED PATENT APPLICATIONS

This patent application claims the benefit of U.S. Provisional Patent Application No. 61/464,597, filed Mar. 7, 2011, the entire teachings and disclosure of which are incorporated herein by reference thereto.

FIELD OF THE INVENTION

The present invention relates to painting tools, and more particularly to tools for assisting in the removal of paint from a tubular roller pad after a painting project is complete.

BACKGROUND OF THE INVENTION

Painting large surfaces such as walls of a building are often done using a paint roller. The paint roller typically includes a removable and replaceable tubular roller pad that can be of different dimensions as well as different types of nap to assist in painting different surfaces and in different sized locations. The paint roller paint saving pan typically includes a handle for gripping by the user attached to a rotatable cage frame to which the roller pad is mounted.

The tubular roller pad can store a large quantity of paint and therefore when a painter is done with a project, it is desirable to remove the excess paint from the roller to conserve paint. Further, the tubular roller pads are often reusable and therefore it is desirable to clean the roller pads such that they can be used at a later date or with a different color paint. Therefore, it is desirable to remove large quantities of the paint prior to cleaning the tubular roller pad.

One way to remove large quantities of excess paint that is stored in the tubular roller pad is to place the tubular roller pad over the edge of a paint can and to scrape the paint using either a painter's five-in-one tool or a paint stirrer. Typically, the tubular roller pad will still be on the paint roller frame during the process of removing the excess paint. Then, the user will remove and wash the tubular roller pad to place it in a clean condition.

Alternatively, numerous devices have been developed that use spinning centrifugal forces to spin the roller pad at a very high rate to fling the excess paint from the roller. Typically, this process is done within a larger bucket or mechanism that catches the excess paint to prevent making a significant mess. Further devices use compressed air or water to run across the tubular roller pad to clean the tubular roller pad. Unfortunately, these devices that either spin the tubular pad or use water or air to remove the paint from the roller pad are complex and typically large. Further, numerous ones of these devices require separate containers that must then subsequently be cleaned and the paint that is extracted from the roller pad must be subsequently pored into the paint can or bucket.

The present invention provides improvements over the current state-of-the-art in devices used to remove excess paint from a tubular roller pad.

BRIEF SUMMARY OF THE INVENTION

The present invention provides embodiments of a new and improved paint roller paint saving pan for removing excess paint from a tubular roller pad. The improved paint roller paint saving pan supports a tubular roller pad vertically above a storage cavity of a paint can while excess paint is scraped from the tubular roller pad using a rigid removal tool.

In a particular embodiment, the paint roller saving pan includes a paint can attachment portion configured to removably axially support the paint roller paint saving pan relative to an open end of an open paint can; a roller pad support portion configured to radially support an end of the tubular roller pad; and a paint catching portion positioned adjacent and vertically below the roller pad support portion and having a through passage permitting fluid communication into the paint can when the paint can attachment portion is vertically supported on the paint can such that paint scraped from the tubular roller pad supported by the roller pad support portion can return back to the paint can.

In a more particular embodiment, the paint can attachment portion is configured to substantially radially fix the position the paint roller paint saving pan relative to the paint can.

In one embodiment, the roller pad support portion is configured to axially support a distal end of the tubular roller pad. The roller pad support portion includes a central post portion including a radial support portion sized to be axially inserted into a central cavity of the tubular roller pad.

In one embodiment, the central post portion of the roller pad support portion includes a stop portion axially spaced from a distal end of the central post portion. The stop portion is greater in dimension than the distal end of the central post portion. The stop portion is configured to provide axial support of the distal end of the tubular roller pad.

In one embodiment, the stop portion is a radially outward extending step portion of the central post portion.

In one embodiment, the radial support portion of the central post portion has a cylindrical outer surface.

In one embodiment, the step portion is an axial end face of a generally frusto-conical extension portion of the central post portion axially interposed between the radial support portion and the paint catching portion.

In one embodiment, the paint catching portion is an annular trough formed between the paint can attachment portion and the roller pad support portion.

In one embodiment, the roller pad support portion includes a central post portion. The paint can attachment portion and the trough are generally annular and spaced radially outward from the central post portion with the trough positioned radially between the central post portion and the paint can attachment portion.

In one embodiment, the passage is at least one aperture formed proximate a bottom of the trough. The at least one aperture fluidly communicating the trough with an interior of the paint can when the paint roller paint saving pan is supported by the paint can.

In one embodiment, the paint can attachment portion includes an axially extending annular flange configured to engage an annular groove in an axial end portion of the open end of the paint can to radially locate the paint roller paint saving pan relative to the open end of the paint can.

In one embodiment, the paint roller paint saving pan further includes a removable adaptor ring having a central hole sized to receive the paint catching portion therein and an outer rim having an outer diameter that is greater than an outer diameter of the paint can attachment portion. The removable adaptor ring being sized to interact with an open end of a larger paint can than which the paint can attachment portion is configured to cooperate with.

In one embodiment, the paint roller paint saving pan is not configured to spin the tubular roller pad to remove excess paint from the tubular roller pad using spinning forces. Further, the paint roller paint saving pan does not include structures configured to spray water at or through the tubular roller pad to remove excess paint from the tubular roller pad. Further, the paint roller paint saving pan does not include structure configured to spray compressed air at or through the tubular roller pad to remove excess paint from the tubular roller pad.

In one embodiment, the roller pad support portion is configured to axially position the tubular roller pad vertically above the paint can attachment portion and the paint catching portion such that no portion of the paint roller paint saving pan that is external to the tubular roller pad is vertically above the end of the tubular roller pad that is supported by the roller pad support portion.

In one embodiment, the paint roller paint saving pan is configured such that when a tubular roller pad having a cylindrical periphery is supported by the roller pad support portion no portion of the paint roller paint saving pan interferes with the rigid removal tool from scraping paint from the cylindrical periphery.

In one embodiment, the paint roller paint saving pan is configured to provide access to at least a portion of a cylindrical outer periphery of the tubular roller pad by the rigid tool to scrape excess paint from the tubular paint roller.

In another embodiment, a method of removing excess paint from a tubular roller pad is provided. The method includes locating a paint roller paint saving pan relative to an open end of a paint can, the paint roller paint saving pan including a roller pad support portion; substantially radially supporting a first end portion of the tubular roller pad with the roller pad support portion; scraping excess paint from the tubular roller pad using a substantially rigid tool by pressing the tool radially inward toward a central axis of the tubular roller pad and against the outer periphery of the tubular roller pad and scraping the outer periphery of the tubular roller pad in a direction aligned with gravity and the central axis and towards the first end portion.

In a further embodiment, the step of radially supporting a first end portion of the tubular roller pad includes inserting the roller pad support portion axially into a central cavity of the tubular roller pad in a direction extending parallel to gravity and the central axis.

In another embodiment, the method further includes radially supporting a second end portion of the tubular roller pad using a paint roller frame. The second end portion being opposite the first end portion. The second end portion being vertically higher than the first end portion during the step of scraping excess paint from the tubular roller pad.

In another embodiment, the method further includes the step of axially displacing the tubular roller pad relative to a paint roller frame along the central axis of the tubular roller pad to expose at least a portion of a central cavity of the tubular roller pad and wherein the step of radially supporting a first end portion includes inserting the tubular roller pad over the roller pad support portion with the roller pad support portion extending axially into the exposed portion of the central cavity.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
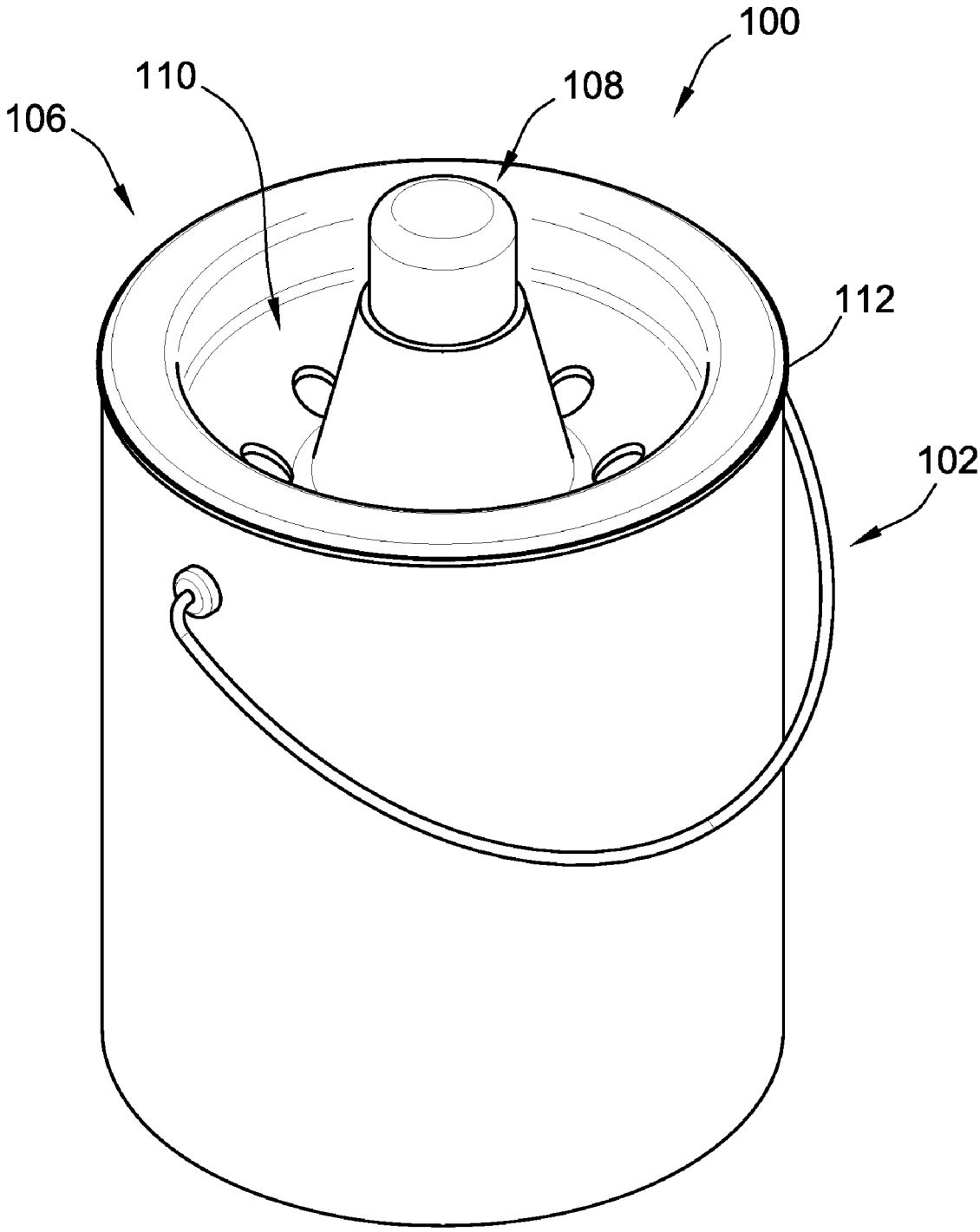
FIG. 1 is a top perspective illustration of an embodiment of a paint roller paint saving pan on a paint can.

FIG. 1 illustrates a paint roller paint saving pan 100 according to an embodiment of the invention in its operational environment on a paint can 102. The paint roller paint saving pan 100 is configured to assist in removing excess paint from a tubular roller pad 104 of a paint roller paint saving pan 178 (see also FIG. 5). The paint roller paint saving pan 100 is configured to support the tubular roller pad 104 in a vertical orientation such that a rigid tool 176 such as a painter's five-in-one tool or a paint stirrer can be used to scrape excess paint from the tubular roller pad 104. The paint roller paint saving pan 100 is also configured such that the excess paint that is scraped from the tubular roller pad 104 can drip back into the paint can 102. While paint can 102 is illustrated as a one gallon paint can, "paint can" as used herein shall be considered to include other structures such as five gallon paint buckets or smaller paint cans.

Figure 2:
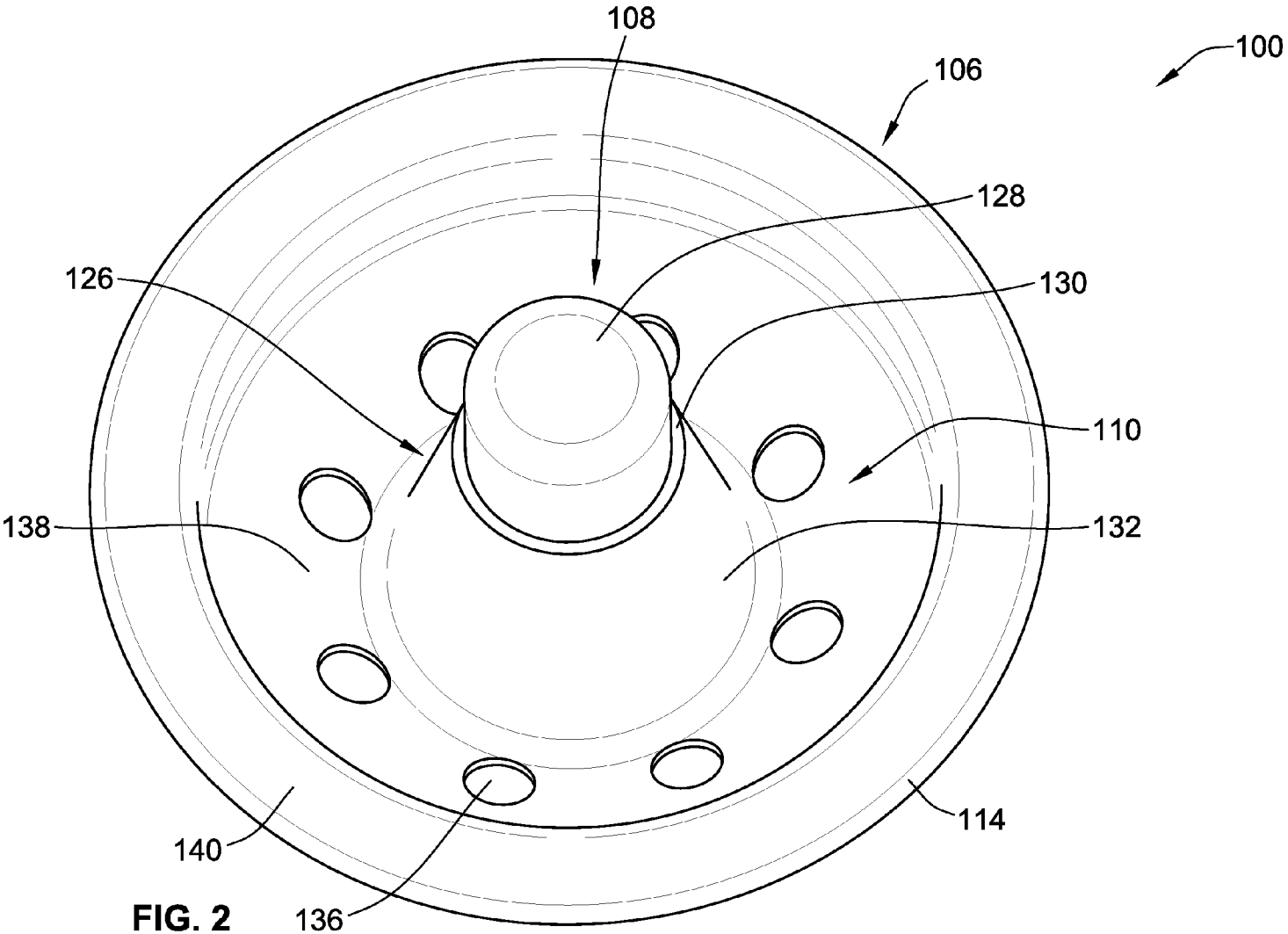
FIG. 2 is a is a top perspective illustration of the paint roller paint saving can of FIG. 1.
Figure 3:
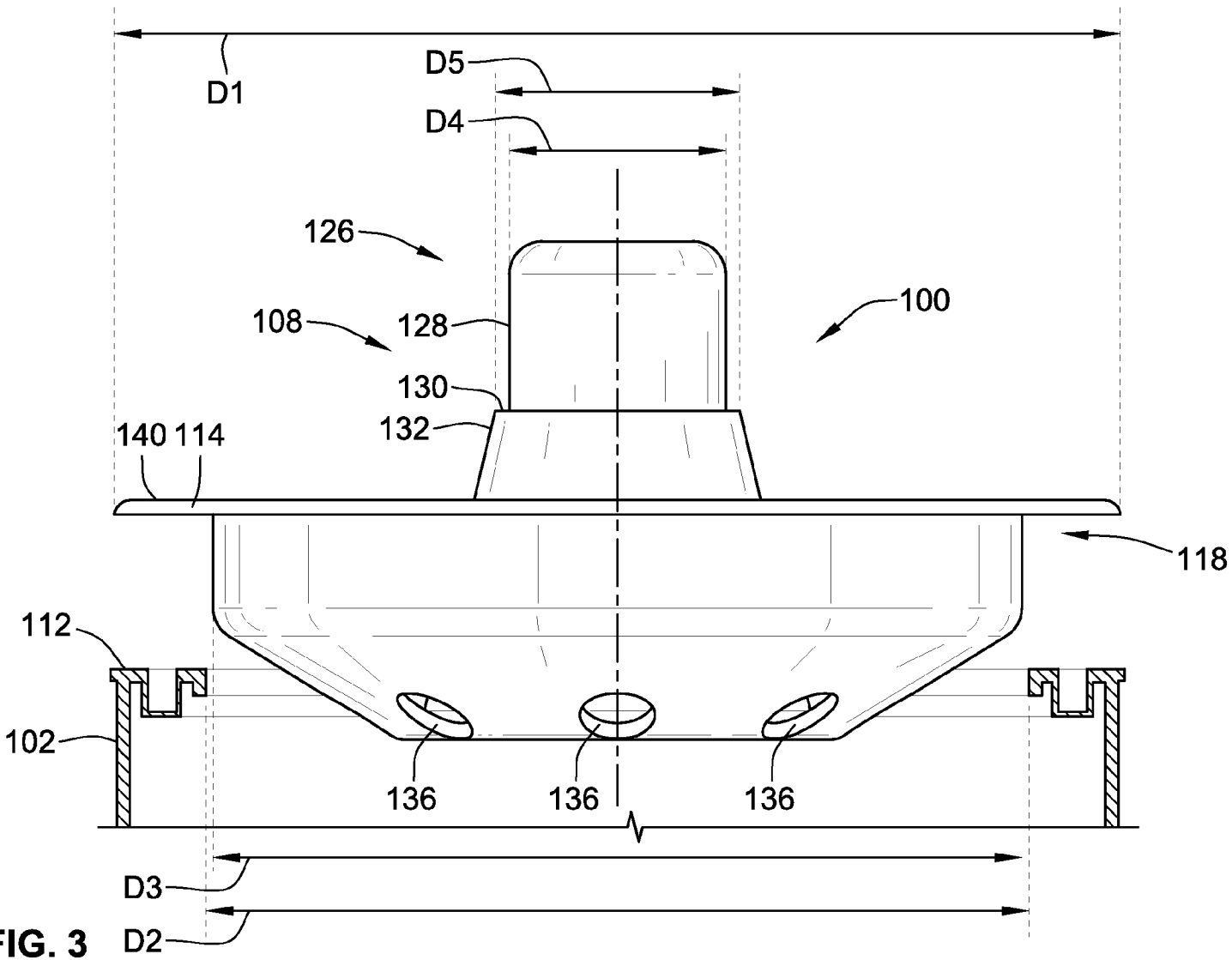
FIG. 3 is a partial exploded illustration of FIG. 1.
Figure 4:
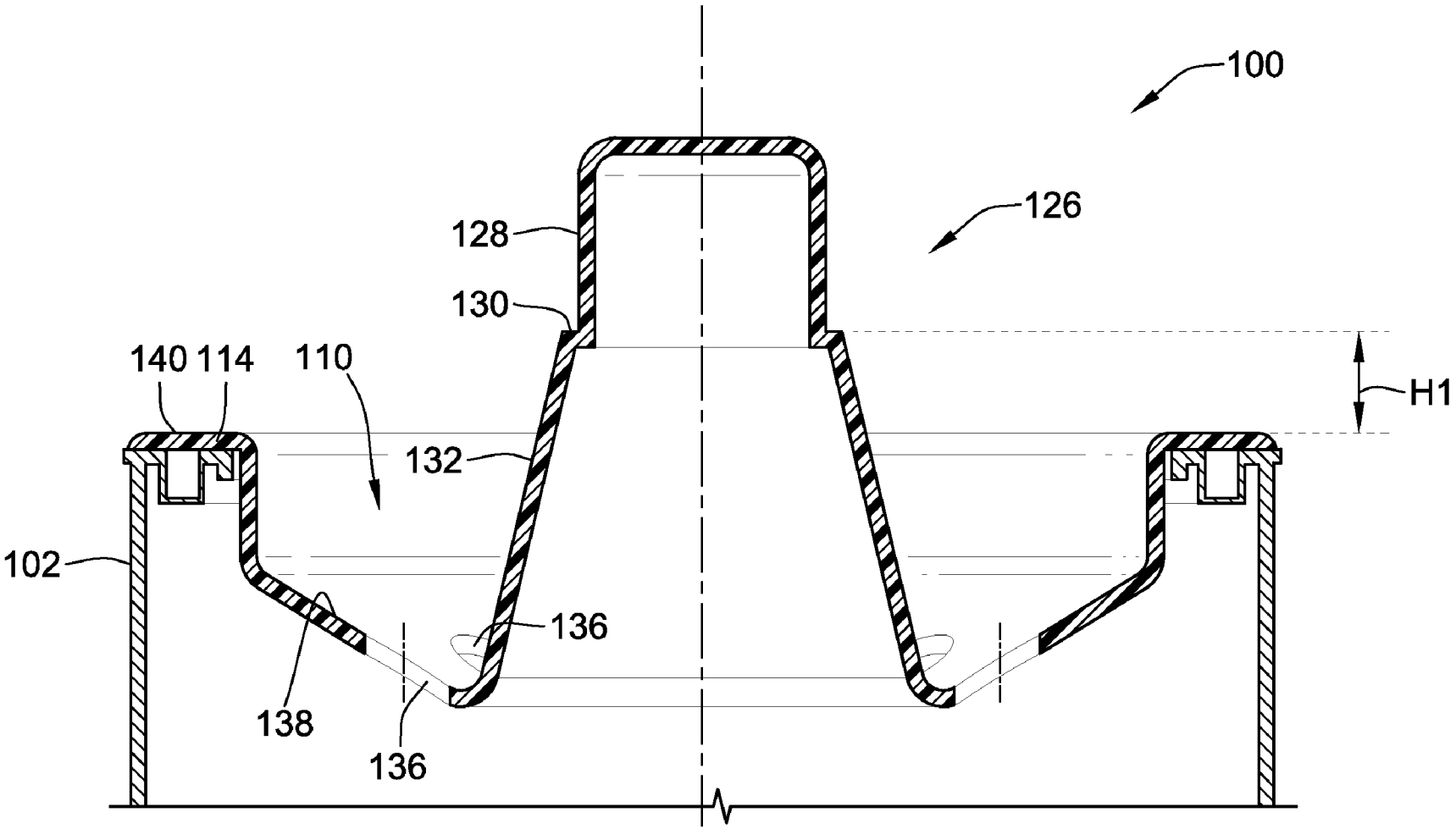
FIG. 4 is a partial cross-sectional illustration of FIG. 1.

With reference to FIGS. 2-4, the paint roller paint saving pan 100 of the illustrated embodiment generally includes a paint can attachment portion 106, a roller pad support portion 108, and a paint catching portion 110. In the illustrated embodiment, the paint can attachment portion 106, roller pad support portion 108, and paint catching portion 110 are integrally formed into a one-piece construction. As used herein, "one-piece construction" shall refer to a single continuous piece of material that is not subsequently connected together. For example, a one-piece construction would be formed by either machining from a single piece of material or molding using a single molding process. The paint roller paint saving pan 100 is typically formed from plastic material, however it could be formed from other material such as metals. Preferably, the material is low stick to make clean-up of thereof easier.

The paint can attachment portion 106 is configured to removably axially support the paint roller paint saving pan 100 relative to an open end 112 of can 102. In the illustrated embodiment, the paint can attachment portion 106 includes a radially outward extending flange portion 114 that has an outer diameter D1 that is greater in dimension than in an inner diameter D2 of the open end 112 of can 102. As such, when the paint roller paint saving pan 100 is axially positioned above or on top of the open end 112 of can 102, the paint can attachment portion 106 prevents the paint roller paint saving pan 100 from falling axially into the paint can 102. The paint can attachment portion 106 also generally includes a radial locating portion 118 which is a vertically downward extending cylindrical outer surface portion. This radial locating portion 118 has an outer diameter D3 that is less than or substantially equal to inner diameter D2 of open end 112 of can 102. The radial locating portion 118 is used to radially locate the paint roller paint saving pan 100 relative to the paint can 102 when mounted to the paint can 102. This prevents the paint roller paint saving pan 100 from radially moving relative to the paint can 102 when lateral forces are applied thereto during a process of removing paint from a tubular roller pad 104.

Alternative radial locating portions could be provided. For instance, an annular depending flange could extend axially downward from the radially outward extending flange portion 114. This axially extending annular flange could be sized to extend into a groove that is typically formed in the open end 112 of can 102 for securing a lid thereto. That axially extending annular flange would then prevent radial movement of the paint roller paint saving pan 100 relative to the can. Further, an alternative embodiment could have an axially extending flange that has an inner diameter that is greater that an outer diameter of can 102 such that the open end 112 of the can 102 is axially received into the annular channel formed by the flange. Therefore, one of ordinary skill in the art will recognize that alternative arrangements for providing radial location of the paint roller paint saving pan 100 relative to a paint can 102 is possible.

The roller pad support portion 108 is used to support a first end 124 (see FIG. 5) of a tubular roller pad 104 during the process of removing excess paint therefrom. The roller pad support portion 108 of the illustrated embodiment is configured to provide both axial and radial support of the distal first end 124 of the tubular roller pad 104. In the illustrated embodiment, the roller pad support portion 108 includes a central post portion 126. The central post portion 126 includes a radial support portion 128 that forms a distal end portion of the central post portion 126. The radial support portion 128 is configured to be axially received into a central cavity 174 defined by the tubular roller pad 104. Therefore, the outer diameter of the radial support portion 128 is smaller or substantially equal to the inner diameter of the tubular roller pad 104. In one embodiment, the outer diameter D4 of the radial support portion 128 is approximately between 1 and 1½ inches and is more preferably approximately between 1⅜ and 1 7/16 inches. It is preferable, but not required, that the diameter D4 of the outer cylindrical surface of radial support portion 128 is closely sized to the inner diameter of the tubular roller paid 104 to prevent significant radial slop therebetween when the radial support portion 128 is axially received into the tubular roller pad 104.

The roller pad support portion 108 also defines an axial stop portion 130. The axial stop portion 130 is configured to engage the distal first end 124 of the tubular roller pad 104. The axial stop portion 130 will provide axial support for the tubular roller pad 104 while a user scrapes excess paint from the tubular roller pad 104 in a vertically downward direction using a rigid tool. In the illustrated embodiment the axial stop portion 130 is an axially facing end face of a frusto-conical extension portion 132 of central post portion 126. The outer diameter D5 of the axial stop portion 130 is greater than the outer diameter D4 of the radial support portion 128. This provides a radial stepped configuration between the frusto-conical extension portion 132 and the radial support portion 128. The axial stop portion 130 is preferably generally cylindrical in shape.

However, in some embodiments the radial support portion 128 and axial stop portion 130 could be provided by a single conical or frusto-conical extension portion. The distal end of such a configuration would be smaller in diameter than the inner diameter of a tubular roller pad however the conical or frusto-conical shape would transition to a larger diameter. Where the diameter of the frusto-conical or conical structure transitions from being less than the inner diameter of the roller pad to greater than the inner diameter of the roller pad would provide the axial stop portion.

The frusto-conical extension portion 132 acts as a funnel or ramp to transition or direct paint that is scraped from a tubular roller pad 104 towards the paint catching portion 110.

The paint catching portion 110 in the illustrated embodiment in generally a trough-shaped portion of the paint roller paint saving pan 100. The trough is generally radially interposed between the paint can attachment portion 106 and the roller pad support portion 108, and particularly the central post portion 126. The paint catching portion 110 is generally the vertically lowest extent of the portion paint roller paint saving pan 100 adjacent the central post portion 126 such that it can catch the paint that is scraped or otherwise removed from the tubular roller pad 104 using the rigid tool. More particularly, the paint will flow under the force of gravity into the paint catching portion 110.

The paint catching portion will also include at least one passage 136 that will allow paint that is caught on an upper surface 138 of the paint catching portion 110 to drip into the interior of the paint can 102. The at least one passage 136 therefore allows fluid communication between the trough-shaped portion (i.e. the upper surface thereof) of the paint catching portion 110 to communicate with the interior of the paint can 102. In the illustrated embodiment, the paint catching portion 110 includes the at least one passage 136 substantially at the lowest extent thereof. This allows all paint caught therein to be dispensed back into the paint can 102 under the force of gravity.

In the illustrated embodiment the axial stop portion 130 is vertically above the paint can attachment portion 106 such as a top surface 140 of the radially outward extending flange portion 114 a height H1 of between about ⅝ and ¾ inches. However, other values are permissible. It is desirable, but not necessary, to have the axial stop portion 130 vertically above the top surface 140 so that none of the rest of the paint roller paint saving pan 100 interferes with access to the outer periphery of the tubular roller pad 104 by the rigid tool used to scrape paint from the tubular roller pad 104. More particularly, if the axial stop portion 130 were vertically recessed below top surface 140, the paint can attachment portion 106 could interfere with access to the bottom end of the tubular roller pad during the paint removal processes.

The illustrated embodiment uses a substantially annular trough-shaped portion with passages 136 as the paint catching portion 110. However, the paint catching portion 110 need not be a full annular trough. Instead the paint catching portion could be provided by mere voids formed in the portion of the painter roller paint saving pan radially outward of the roller pad support portion 108. For instance, the paint roller paint saving pan 100 could be formed by four leg portions that form a general cross shape. The distal ends of the four leg portions would then be angularly spaced from one another. These distal end portions would provide the paint can attachment portion and axially abut an open end 112 of can 102. This is unlike the continuous annular flange 114 of the instant embodiment.

Figure 5:
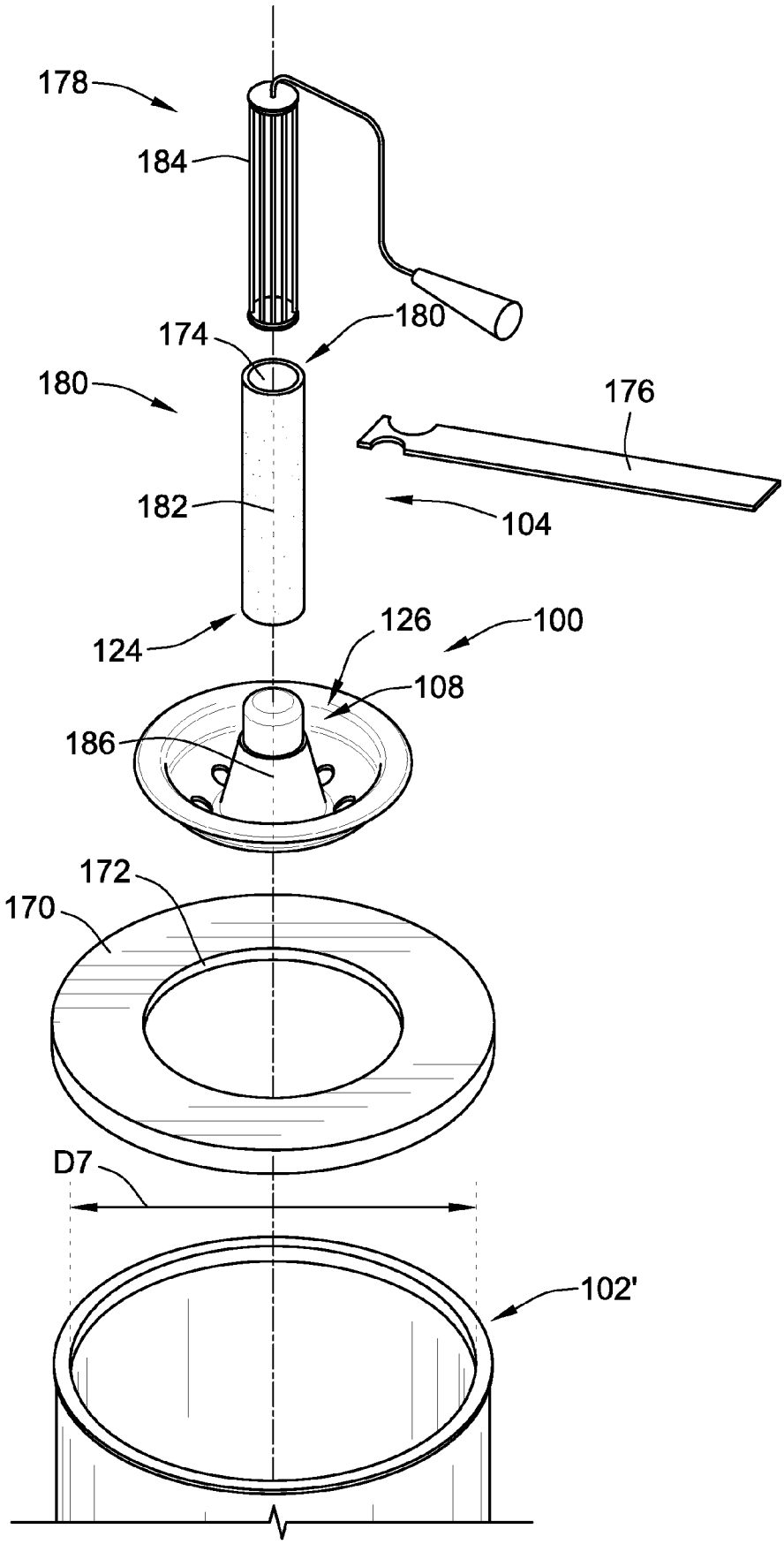
FIG. 5 is an exploded perspective illustration of an alternative embodiment of a paint roller paint saving pan.
Figure 7:
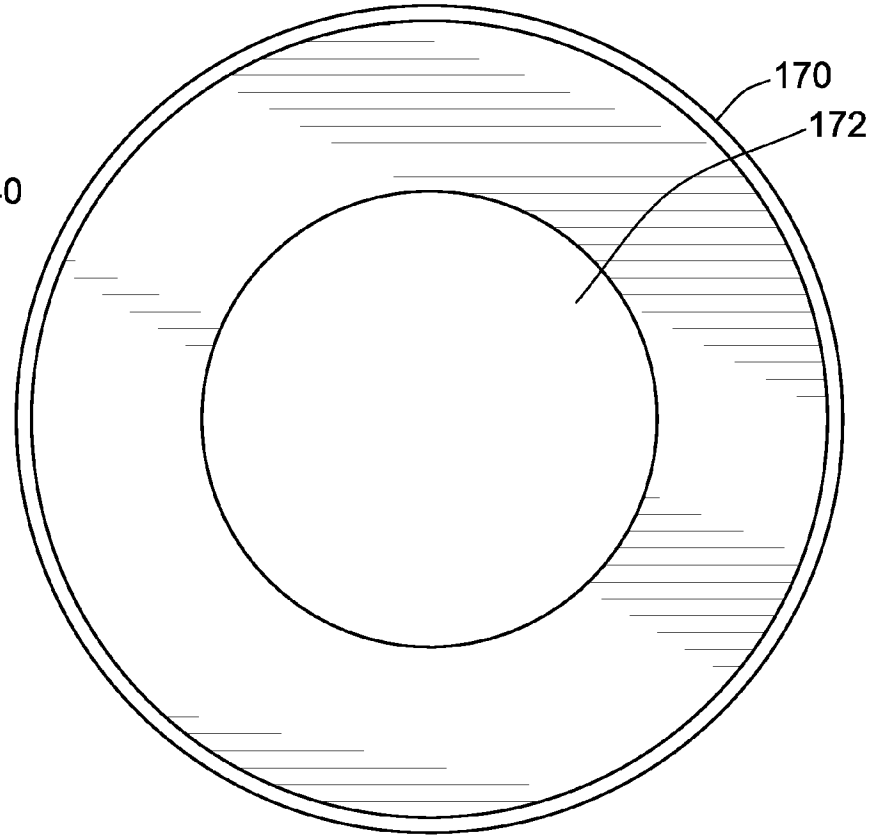
FIG. 7 is a top view of the embodiment of FIG. 5.
Figure 6:
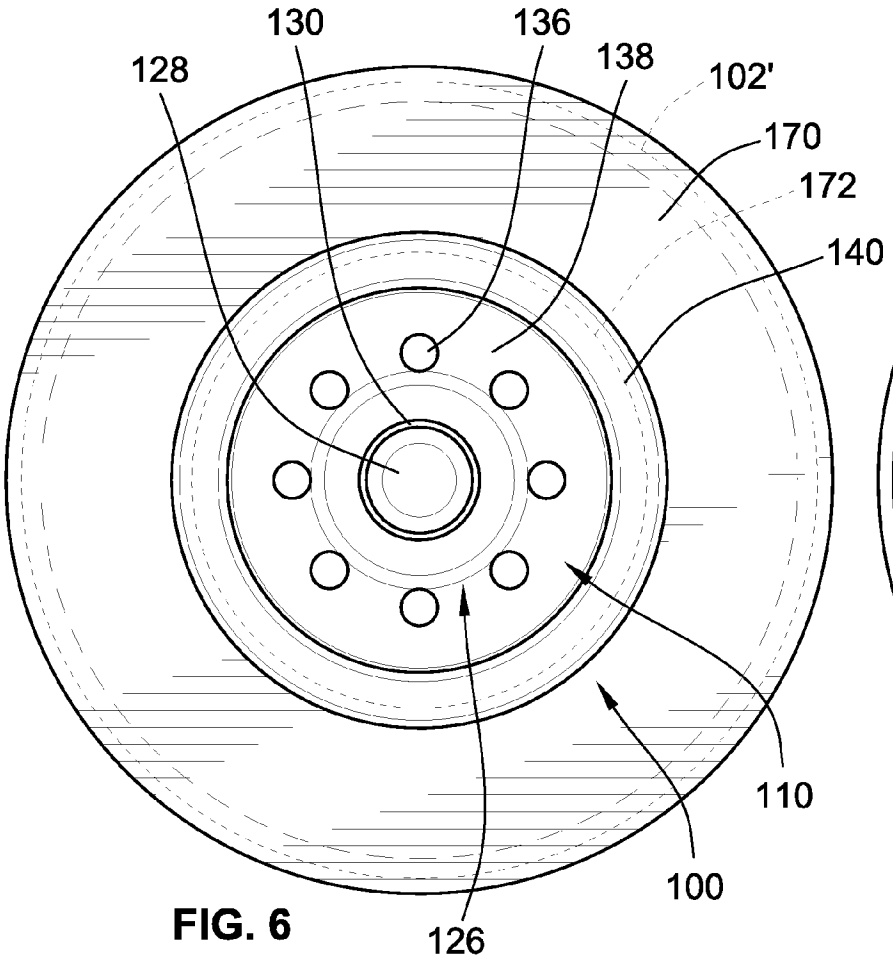
FIG. 6 is a top view of an adaptor ring of FIG. 5.

FIG. 5 illustrates a further use of the paint roller paint saving pan 100. More particularly, the illustrated embodiment can be used with a paint can in the form of a five gallon paint bucket 102' even though the outer diameter of the paint can attachment portion 106 is significantly less than the inner diameter D7 of the open end of the paint bucket 102'. In this configuration, an adapter 170 is used to make up the radial difference between the outer diameter D1 of the radially outward extending flange 114 and the inner diameter D7. A mounting hole 172 is sized to receive the radial locating portion 118. Such that the mounting hole 172 substantially acts as the open end of the smaller one gallon paint can 102 in the prior discussion. In one embodiment, the adapter 170 is simply a five gallon paint bucket lid that has the mounting hole 172 removed therefrom.

In operation, the paint roller paint saving pan 100 is used to assist in removing excess paint from the nap of the tubular roller pad 104 forming the outer cylindrical periphery thereof. More particularly, a user will support a first end 124 of the tubular roller pad 104 using the roller pad support portion 108 of the paint roller paint saving pan 100. The user will insert the roller pad support portion 108 into the internal cavity 174 of the tubular roller pad at the first end 124. With the tubular roller pad 104 radially and axially supported by the paint roller paint saving pan 100, the user can use a rigid tool 176 to scrape the outer periphery of the tubular roller pad 104 in a vertically downward direction while supplying radially inward directed pressure on the outer periphery of the tubular roller pad 104. This scraping action will remove bulk volumes of excess paint stored in the nap of the tubular roller pad 104. The direction of scraping will typically be aligned with gravity so that gravity assists in depositing the removed paint into the paint catching portion 110 and then into the interior of the paint can 102 via the passages 136 in the paint catching portion 110.

In one method, the user can use the paint roller 178 to assist in holding the second end 108 of the tubular roller pad 104. More particularly, the user will align the central axis 182 about which the tubular roller pad 104 extends with the pull of gravity. The user will typically axially displace the tubular roller pad 104 relative to the cage frame portion 184 of the paint roller 178 to expose at least a portion of the central cavity 174 of the tubular roller pad 104. This portion of the internal cavity 174 that is now exposed will receive the roller pad support portion 108. Thus the user will be able to fully support and control the tubular roller pad 104 while applying the scraping forces with tool 176.

It should be noted that the present paint roller paint saving pan 100 is not used to fully clean the tubular roller pad 104. Further, the method and apparatus and do not require the use of spinning forces to centrifugally cause paint to be expelled from the tubular roller pad 104. Further, no compressed air or water is also required to be used to remove the excess surplus paint stored within the tubular roller pad 104. Finally, the paint roller paint saving pan 100 is generally configured not to interfere with access to any portion of the cylindrical outer periphery of the tubular roller pad 104 when it is supported by the paint roller paint saving pan 100 when the tubular roller pad 104 has its central axis 182 generally aligned with gravity and the central axis 186 of the central post portion 126.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A paint roller paint saving pan for supporting a tubular roller pad vertically above a storage cavity of a paint can while excess paint is scraped from the tubular roller pad using a rigid removal tool, the paint roller saving pan comprising:

a paint can attachment portion configured to removably axially support the paint roller paint saving pan relative to an open end of an open paint can;

a roller pad support portion configured to radially support an end of the tubular roller pad;

a paint catching portion in the form of a trough positioned adjacent and vertically below the roller pad support portion and having a through passage permitting fluid communication into the paint can when the paint can attachment portion is vertically supported on the paint can such that paint scraped from the tubular roller pad supported by the roller pad support portion can return back to the paint can;

wherein the roller pad support portion is configured to axially support a distal end of the tubular roller pad, the roller pad support portion includes a central post portion including a radial support portion sized to be axially inserted into a central cavity of the tubular roller pad;

wherein the central post portion of the roller pad support portion includes a stop portion axially spaced from a distal end of the central post portion, the stop portion being greater in dimension than the distal end of the central post portion, the stop portion being configured to provide axial support of the distal end of the tubular roller pad;

wherein the stop portion is a radially outward extending step portion of the central post portion; and wherein the paint can attachment portion and the trough are generally annular and spaced radially outward from the central post portion with the trough positioned radially between the central post portion and the paint can attachment portion.

2. The paint roller paint saving pan of claim 1, wherein the paint can attachment portion is configured to substantially radially fix the position the paint roller paint saving pan relative to the paint can.

3. The paint roller paint saving pan of claim 1, wherein the radial support portion of the central post portion has a cylindrical outer surface.

4. The paint roller paint saving pan of claim 1, wherein the step portion is an axial end face of a generally frusto-conical extension portion of the central post portion axially interposed between the radial support portion and the paint catching portion.

5. The paint roller paint saving pan of claim 1, wherein the passage is at least one aperture formed proximate a bottom of the trough, the at least one aperture fluidly communicating the trough with an interior of the paint can when the paint roller paint saving pan is supported by the paint can.

6. The paint roller paint saving pan of claim 1, wherein the paint can attachment portion includes an axially extending annular flange configured to engage an annular groove in an axial end portion of the open end of the paint can to radially locate the paint roller paint saving pan relative to the open end of the paint can.

7. The paint roller paint saving pan of claim 1, wherein the paint roller paint saving pan is not configured to spin the tubular roller pad to remove excess paint from the tubular roller pad using spinning forces, the paint roller paint saving pan does not include structures configured to spray water at or through the tubular roller pad to remove excess paint from the tubular roller pad, the paint roller paint saving pan does not include structure configured to spray compressed air at or through the tubular roller pad to remove excess paint from the tubular roller pad.

8. The paint roller paint saving pan of claim 1, wherein the roller pad support portion is configured to axially position the tubular roller pad vertically above the paint can attachment portion and the paint catching portion such that no portion of the paint roller paint saving pan that is external to the tubular roller pad is vertically above the end of the tubular roller pad that is supported by the roller pad support portion.

9. The paint roller paint saving pan of claim 1, wherein the paint roller paint saving pan is configured such that when a tubular roller pad having a cylindrical periphery is supported by the roller pad support portion, no portion of the paint roller paint saving pan interferes with the rigid removal tool from scraping paint from the cylindrical periphery.

10. The paint roller paint saving pan of claim 1, wherein the paint roller paint saving pan is configured to provide access to at least a portion of a cylindrical outer periphery of the tubular roller pad by the rigid tool to scrape excess paint from the tubular paint roller.

11. A paint roller paint saving pan for supporting a tubular roller pad vertically above a storage cavity of a paint can while excess paint is scraped from the tubular roller pad using a rigid removal tool, the paint roller saving pan comprising:

a paint can attachment portion configured to removably axially support the paint roller paint saving pan relative to an open end of an open paint can;

a roller pad support portion configured to radially support an end of the tubular roller pad;

a paint catching portion positioned adjacent and vertically below the roller pad support portion and having a through passage permitting fluid communication into the paint can when the paint can attachment portion is vertically supported on the paint can such that paint scraped from the tubular roller pad supported by the roller pad support portion can return back to the paint can; and a removable adaptor ring having a central hole sized to receive the paint catching portion therein and an outer rim having an outer diameter that is greater than an outer diameter of the paint can attachment portion, the removable adaptor ring being sized to interact with an open end of a larger paint can.

12. The paint roller paint saving pan of claim 11, wherein the roller pad support portion is configured to axially support a distal end of the tubular roller pad, the roller pad support portion includes a central post portion including a radial support portion sized to be axially inserted into a central cavity of the tubular roller pad.

13. The paint roller paint saving pan of claim 12, wherein the central post portion of the roller pad support portion includes a stop portion axially spaced from a distal end of the central post portion, the stop portion being greater in dimension than the distal end of the central post portion, the stop portion being configured to provide axial support of the distal end of the tubular roller pad.

14. The paint roller paint saving pan of claim 13, wherein the stop portion is a radially outward extending step portion of the central post portion.

15. A method of removing excess paint from a tubular roller pad comprising:

locating a paint roller paint saving pan relative to an open end of a paint can, the paint roller paint saving pan configured for supporting a tubular roller pad vertically above a storage cavity of a paint can while excess paint is scraped from the tubular roller pad using a rigid removal tool, the paint roller saving pan including:

a paint can attachment portion configured to removably axially support the paint roller paint saving pan relative to the open end of the open paint can;

a roller pad support portion configured to radially support a first end portion of the tubular roller pad;

a paint catching portion in the form of a trough positioned adjacent and vertically below the roller pad support portion and having a through passage permitting fluid communication into the paint can when the paint can attachment portion is vertically supported on the paint can such that paint scraped from the tubular roller pad supported by the roller pad support portion can return back to the paint can;

wherein the roller pad support portion is configured to axially support a distal of the tubular roller pad, the roller pad support portion includes a central post portion including a radial support portion sized to be axially inserted into a central cavity of the tubular roller pad;

wherein the central post portion of the roller pad support portion includes a stop portion axially spaced from a distal end of the central post portion, the stop portion being greater in dimension than the distal end of the central post portion, the stop portion being configured to provide axial support of the distal end of the tubular roller pad;

wherein the stop portion is a radially outward extending step portion of the central post portion; and wherein the paint can attachment portion and the trough are generally annular and spaced radially outward from the central post portion with the trough positioned radially between the central post portion and the paint can attachment portion;

substantially radially supporting the first end portion of the tubular roller pad with the roller pad support portion;

scraping excess paint from the tubular roller pad using the substantially rigid tool by pressing the tool radially inward toward a central axis of the tubular roller pad and against the outer periphery of the tubular roller pad and scraping the outer periphery of the tubular roller pad in a direction aligned with gravity and the central axis and towards the first end portion.

16. The method of claim 15, wherein the step of radially supporting a first end portion of the tubular roller pad includes inserting the roller pad support portion axially into a central cavity of the tubular roller pad in a direction extending parallel to gravity and the central axis.

17. The method of claim 16, further comprising radially supporting a second end portion of the tubular roller pad using a paint roller frame, the second end portion being opposite the first end portion, the second end portion being vertically higher than the first end portion during the step of scraping excess paint from the tubular roller pad.

18. The method of claim 15, further comprising the step of axially displacing the tubular roller pad relative to a paint roller frame along the central axis of the tubular roller pad to expose at least a portion of a central cavity of the tubular roller pad;

wherein the step of radially supporting a first end portion includes inserting the tubular roller pad over the roller pad support portion with the roller pad support portion extending axially into the exposed portion of the central cavity.

* * * * *